US007437996B2

(12) United States Patent
Turner et al.

(10) Patent No.: US 7,437,996 B2
(45) Date of Patent: Oct. 21, 2008

(54) KINETIC ENERGY PENETRATOR AND METHOD OF USING SAME

(75) Inventors: Mark A. Turner, Arlington, TX (US); William R. Greisser, Lewisville, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 84 days.

(21) Appl. No.: 11/231,679

(22) Filed: Sep. 21, 2005

(65) Prior Publication Data

US 2008/0148986 A1 Jun. 26, 2008

(51) Int. Cl.
*F42B 12/58* (2006.01)
*F42B 30/00* (2006.01)

(52) U.S. Cl. ..... 102/489; 102/383; 102/217; 86/51

(58) Field of Classification Search ..... 102/383, 102/393, 433, 434, 438, 475, 477, 480, 489, 102/491, 492, 494, 504, 517; 86/51, 53
See application file for complete search history.

(56) References Cited

U.S. PATENT DOCUMENTS

| | | | | | |
|---|---|---|---|---|---|
| 1,045,671 | A * | 11/1912 | Bureau | 102/477 |
| 2,327,141 | A * | 8/1943 | Spencer | 175/4.54 |
| 2,357,951 | A * | 9/1944 | Hale | 124/72 |
| 3,111,086 | A * | 11/1963 | Alperstein | 102/393 |
| 3,419,274 | A * | 12/1968 | MacDonald | 473/577 |
| 3,439,610 | A * | 4/1969 | Myers | 102/383 |
| 3,718,089 | A * | 2/1973 | Wiese | 102/433 |
| 3,829,940 | A * | 8/1974 | Fischer | 86/53 |
| 3,860,199 | A * | 1/1975 | Dunne | 244/3.13 |
| 4,210,082 | A * | 7/1980 | Brothers | 102/401 |
| 4,372,216 | A * | 2/1983 | Pinson et al. | 102/489 |
| 4,455,943 | A * | 6/1984 | Pinson | 102/489 |
| 4,559,876 | A * | 12/1985 | Bocker et al. | 102/520 |
| 4,624,187 | A * | 11/1986 | Bocker et al. | 102/520 |
| 4,625,646 | A * | 12/1986 | Pinson | 102/489 |
| 4,676,167 | A * | 6/1987 | Huber et al. | 102/393 |
| H343 | H * | 10/1987 | Keown et al. | 102/517 |
| 4,899,661 | A * | 2/1990 | Kaelin | 102/495 |
| 5,191,169 | A * | 3/1993 | Hu | 102/476 |
| 6,492,632 | B1 * | 12/2002 | Pollin | 244/3.3 |
| 7,036,434 | B1 * | 5/2006 | Vo et al. | 102/522 |
| 2002/0121214 | A1 * | 9/2002 | Ledys et al. | 102/477 |

FOREIGN PATENT DOCUMENTS

EP 146745 A1 * 7/1985

* cited by examiner

*Primary Examiner*—Bret Hayes
(74) *Attorney, Agent, or Firm*—Daren C. Davis; James E. Walton

(57) ABSTRACT

A kinetic energy penetrator includes a plurality of penetrator segments, a penetrator segment sleeve for storing the plurality of penetrator segments, and means for moving the plurality of penetrator segments from the penetrator segment sleeve to locations substantially aligned along an axis of attack. A method includes storing a plurality of penetrator segments away from an axis of attack and moving the plurality of penetrator segments to locations substantially aligned along the axis of attack. A vehicle includes a body and a kinetic energy penetrator disposed in a forward portion of the vehicle. The kinetic energy penetrator includes a plurality of penetrator segments, a penetrator segment sleeve for storing the plurality of penetrator segments, and means for moving the plurality of penetrator segments from the penetrator segment sleeve to locations substantially aligned along an axis of attack.

20 Claims, 9 Drawing Sheets

KINETIC ENERGY PENETRATOR AND METHOD OF USING SAME

BACKGROUND

1. Field of the Invention

The present invention relates to kinetic energy penetrators. In particular, the present invention relates to a kinetic energy penetrator having movable penetrator segments and a method for using the penetrator.

2. Description of Related Art

Generally, a kinetic energy weapon uses kinetic energy, rather than, for example, explosive energy, to defeat a target. A conventional kinetic energy weapon, such as a kinetic energy projectile 101 shown in FIG. 1, typically includes a precursor 103 and penetrator rod 105, each comprising a relatively dense material, such as tungsten, steel, depleted uranium, or the like. When kinetic energy projectile 101 reaches a target, precursor 103 generates an opening, or at least an area of reduced strength, in the target through which penetrator rod 105 travels as kinetic energy projectile 101 continues to impact the target. Penetrator rod 105, whether intact or fragmented, impacts materiel and/or personnel within the target to defeat the materiel and/or personnel.

Still referring to FIG. 1, precursor 103 is typically disposed forward of a control section 107 of kinetic energy projectile 101. Control section 107 includes, among other things, elements that locate targets and/or adjust control surfaces 109 of kinetic energy projectile 101 to deliver kinetic energy projectile 101 to a target. Penetrator rod 105 extends from aft of control section 107, through a passageway 111 defined by a propellant 113, to proximate a motor 115. Note that propellant 113 is consumed by motor 115 to propel kinetic energy projectile 101.

Such a conventional configuration, however, presents several problems. For example, a center of gravity of kinetic energy projectile 101 must be forward of a center of aerodynamic pressure of projectile 101 for projectile 101 to be stable during flight. Moreover, it is highly desirable for the center of gravity to be as far forward of the center of aerodynamic pressure as possible, resulting in more aerodynamically stable flight. Penetrator rod 105, however, has considerable mass and much of penetrator rod 105 is disposed toward the aft end of kinetic energy projectile 101, resulting in the center of gravity of kinetic energy penetrator 101 being further aft than desired. It should be noted that the center of pressure of kinetic energy projectile 101 moves forward as the velocity of kinetic energy penetrator 101 increases. As a result, larger control surfaces 109, needed for higher speed flight and resulting in increased weight of kinetic energy penetrator 101, are unnecessary for lower speed flight. Moreover, penetrator rod 105 occupies a central volume of propellant 113, thus reducing the amount of propellant 113 in kinetic energy projectile 101. Less propellant 113 results in kinetic energy projectile 101 being able to travel a shorter distance to a target and/or having a lower impact velocity at the target.

While there are many projectiles incorporating kinetic energy penetrators well known in the art, considerable room for improvement remains.

SUMMARY OF THE INVENTION

There is a need for an improved kinetic energy penetrator.

Therefore, it is an object of the present invention to provide an improved kinetic energy penetrator.

In one aspect, the present invention provides a kinetic energy penetrator. The kinetic energy penetrator includes a plurality of penetrator segments, a penetrator segment sleeve for storing the plurality of penetrator segments, and means for moving the plurality of penetrator segments from the penetrator segment sleeve to locations substantially aligned along an axis of attack.

In another aspect of the present invention, a kinetic energy penetrator is provided. The kinetic energy penetrator includes a tube, means for moving the tube from a retracted position to an extended position, and a plurality of penetrator segments. The kinetic energy penetrator further includes a penetrator segment sleeve for storing the plurality of penetrator segments and means for moving the plurality of penetrator segments from the penetrator segment sleeve into the tube when the tube is in the extended position.

In yet another aspect, the present invention provides a method including storing a plurality of penetrator segments away from an axis of attack and moving the plurality of penetrator segments to locations substantially aligned along the axis of attack.

In another aspect, the present invention provides a vehicle. The vehicle includes a body and a kinetic energy penetrator disposed in a forward portion of the vehicle. The kinetic energy penetrator includes a plurality of penetrator segments, a penetrator segment sleeve for storing the plurality of penetrator segments, and means for moving the plurality of penetrator segments from the penetrator segment sleeve to locations substantially aligned along an axis of attack.

The present invention provides significant advantages, including: (1) providing a vehicle operably associated with the present invention to exhibit a higher degree of aerodynamic and/or hydrodynamic stability; (2) providing a vehicle operably associated with the present invention to hold more propellant and, thus, reach targets at greater distances; (3) providing a vehicle operably associated with the present invention having less aerodynamic drag.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote (s) the first figure in which the respective reference numerals appear, wherein:

Figure 1:
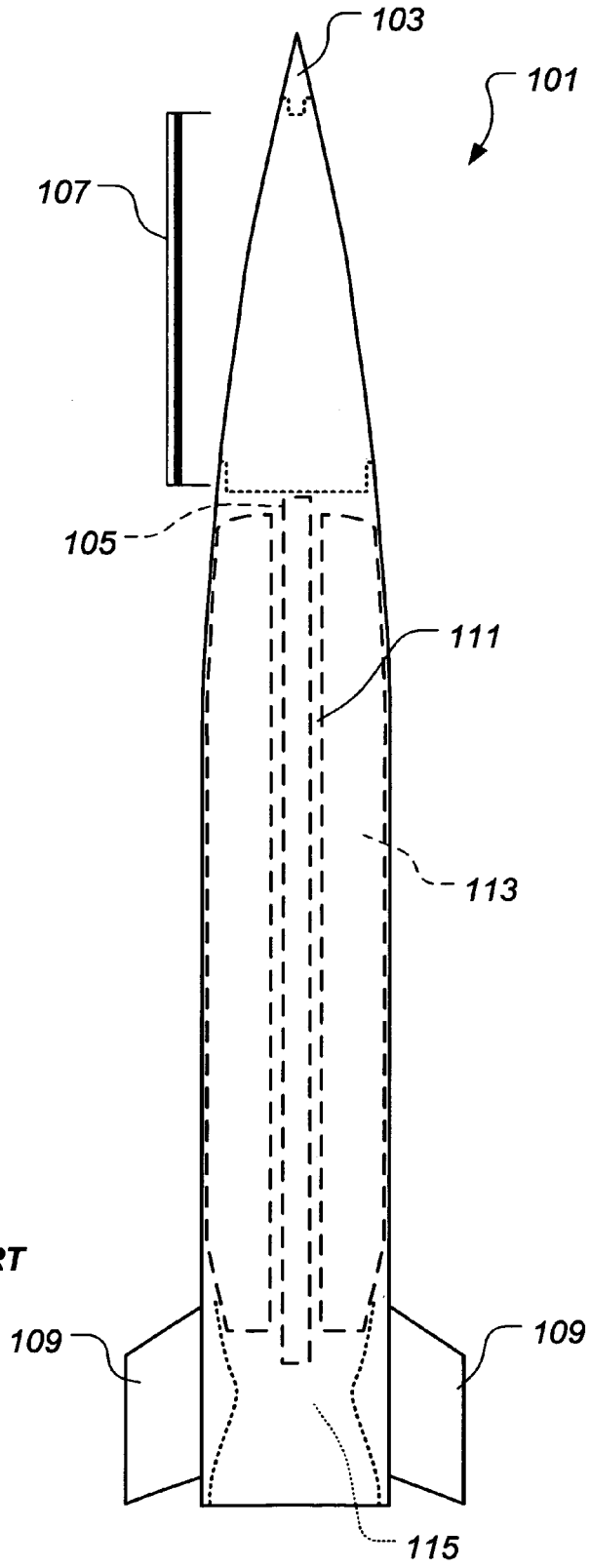
FIG. 1 PRIOR ART
FIG. 1 is a stylized, side, elevational view of a conventional kinetic energy projectile.
Figure 2:
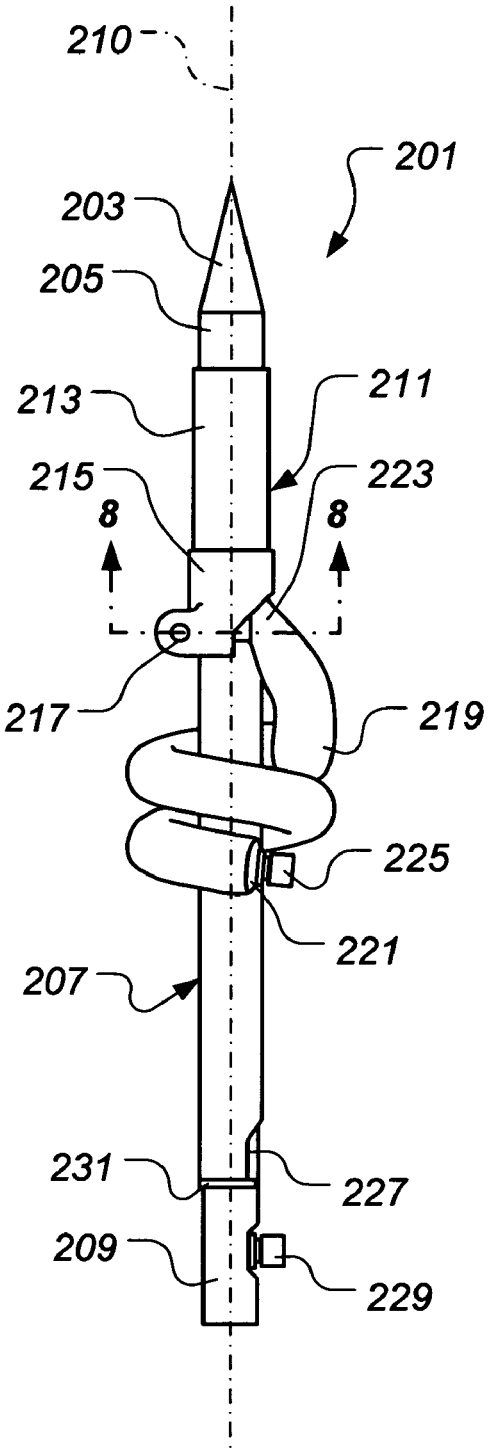
FIG. 2 is a top, plan view of an illustrative embodiment of an kinetic energy penetrator according to the present invention in a retracted configuration.
Figure 3:
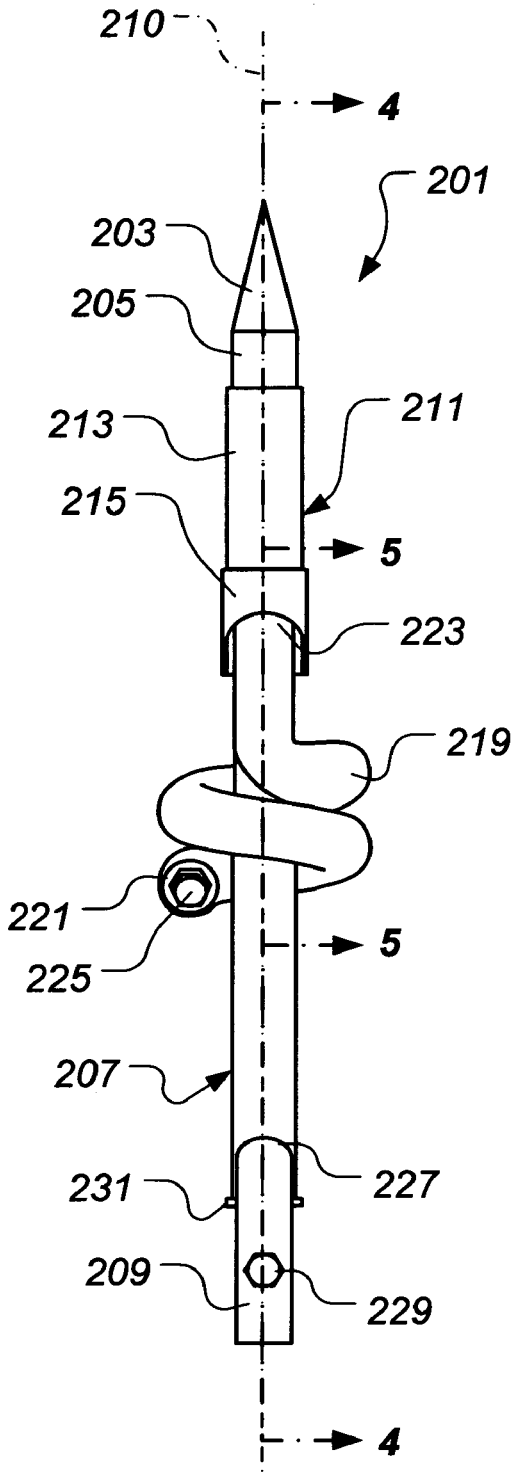
FIG. 3 is a side, elevational view of the kinetic energy penetrator of FIG. 2.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention represents a kinetic energy penetrator adapted to be operably associated with an airborne or waterborne vehicle, such as a projectile, a rocket, a missile, a torpedo, a drone, or the like. In a preferred embodiment, the kinetic energy penetrator comprises a precursor disposed in a forward end of an extension tube, a plurality of penetrator segments, and a penetrator rod. In one embodiment, each of the precursor, the penetrator segments, and the penetrator rod is a kinetic energy penetrator. The extension tube is movable from a retracted position to an extended position. Preferably, the extension tube is extended just prior to impact with a target or prior to launch of a vehicle incorporating the present kinetic energy penetrator. When the extension tube is in the retracted position, the precursor and the penetrator rod are substantially aligned along an axis of attack, while the penetrator segments are stored in a circuitous penetrator segment sleeve disposed about the extension tube. After the extension tube is moved to the extended position, the penetrator segments are urged from the penetrator segment sleeve into the extension tube. When disposed in the extension tube, the penetrator segments are substantially aligned along the axis of attack, between the precursor and the penetrator rod.

FIGS. 2-5 and 8 depict an illustrative embodiment of a kinetic energy penetrator 201 according to the present invention in a retracted configuration. FIGS. 9-13 depict kinetic energy penetrator 201 in an extended configuration. Referring in particular to FIGS. 2-5, kinetic energy penetrator 201 comprises a precursor 203 disposed in a forward end 205 of an extension tube 207. Generally, precursor 203 inflicts the first damage to a target as kinetic energy penetrator 201 encounters the target. As illustrated in FIGS. 2-5 and 8, precursor 203 is a kinetic energy precursor, preferably comprising a hard, dense material. For example, in various embodiments, precursor 203 may comprise tungsten, a tungsten alloy, a steel, an iron alloy, depleted uranium, and/or a depleted uranium alloy. In other embodiments, however, precursor may be a chemical energy warhead, such as a shaped charge device 601 (shown in FIG. 6), an explosively formed penetrator device 701 (shown in FIG. 7), or the like.

Figure 6:
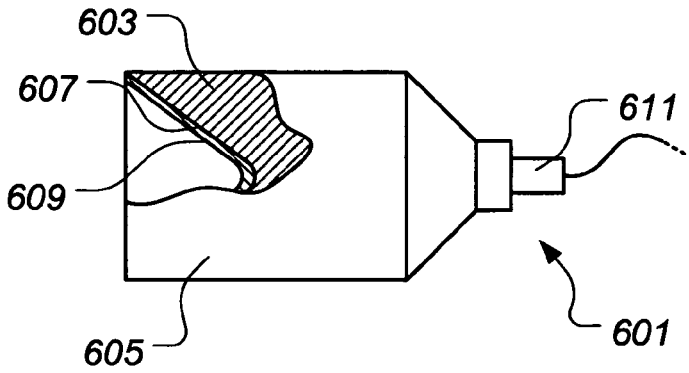
FIG. 6 is a stylized, partial cross-sectional view of an illustrative embodiment of a shaped charge precursor according to the present invention.

Referring to FIG. 6, shaped charge devices employ explosive products, resulting from the detonation of a highly explosive material, to create great pressures that accelerate a liner and form a very high-speed metal jet. In the illustrated embodiment, shaped charge device 601 comprises an explosive charge 603 partially encased by a casing 605. Explosive charge 603 may comprise any explosive material known in the art having a high detonation velocity and/or high brisance, e.g., materials containing cyclotetramethylenetetranitramine (e.g., HMX), an HMX blend, cyclotrimethylenetrinitramine (e.g., RDX), an RDX blend, an HMX/estane blend (e.g., LX-14), or the like. Generally, a high detonation velocity explosive is characterized as having a detonation velocity of at least about 6000 meters per second.

Still referring to FIG. 6, explosive charge 603 defines a concave forward face 607. A liner 609 is affixed to forward face 607. In the illustrated embodiment, forward face 607 and liner 609 are generally V-shaped in cross-section; however, the invention is not so limited. Rather, forward face 607 and liner 609 may have any cross-sectional shape suitable for shaped charge device 601, such as a tulip shape, a biconic shape, a trumpet shape, a hemispherical shape, or the like. Liner 609 may comprise any suitable material for shaped charge device liners, such as copper or a copper alloy. Explosive charge 603 is initiated by a detonator 611.

Figure 7:
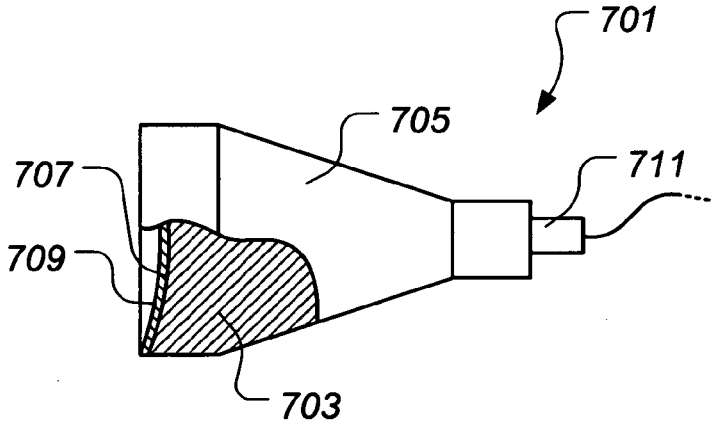
FIG. 7 is a stylized, partial cross-sectional view of an illustrative embodiment of an explosively formed penetrator precursor according to the present invention.

Referring now to FIG. 7, explosively formed projectile devices employ explosive products, created by detonating a highly explosive material, to create great pressures that accelerate a liner while simultaneously reshaping the liner into a rod or some other chosen shape. In the illustrated embodiment, explosively formed projectile device 701 comprises an explosive charge 703 partially encased by a casing 705. Explosive charge 703 may comprise any explosive material known in the art having a high detonation velocity and/or high brisance, as discussed above regarding shaped charge device 601. Explosively formed projectile device 701 further includes a liner 707 affixed to a concave, substantially flat, or convex forward face 709 of explosive charge 703. Both forward face 709 and the liner 707 affixed thereto may have any shape suitable for explosively formed projectile device 701. Liner 707 may comprise any material suitable for explosively formed projectile device liners, such as copper, a copper alloy, or the like. Explosive charge 703 is initiated by a detonator 711.

Referring again to FIGS. 2-5, extension tube 207 is slidingly disposed over a kinetic energy penetrator rod 209 that, preferably, comprises a hard, dense material, such as the materials discussed above regarding precursor 203. Precursor 203 and penetrator rod 209 are substantially aligned along an axis of attack 210. As illustrated best in FIG. 5, penetrator rod 209 defines a groove 501. A sealing element 503 is disposed in groove 501 and contacts an inner surface 507 of extension tube 207. Sealing element 503 provides a fluid seal between penetrator rod 209 and inner surface 507. Sealing element 503 inhibits a flow of fluid along an annulus between penetrator rod 209 and inner surface 507 of extension tube 207 when extension tube 207 is moved from the retracted position to the extended position, as will be discussed in greater detail below.

Figure 8:
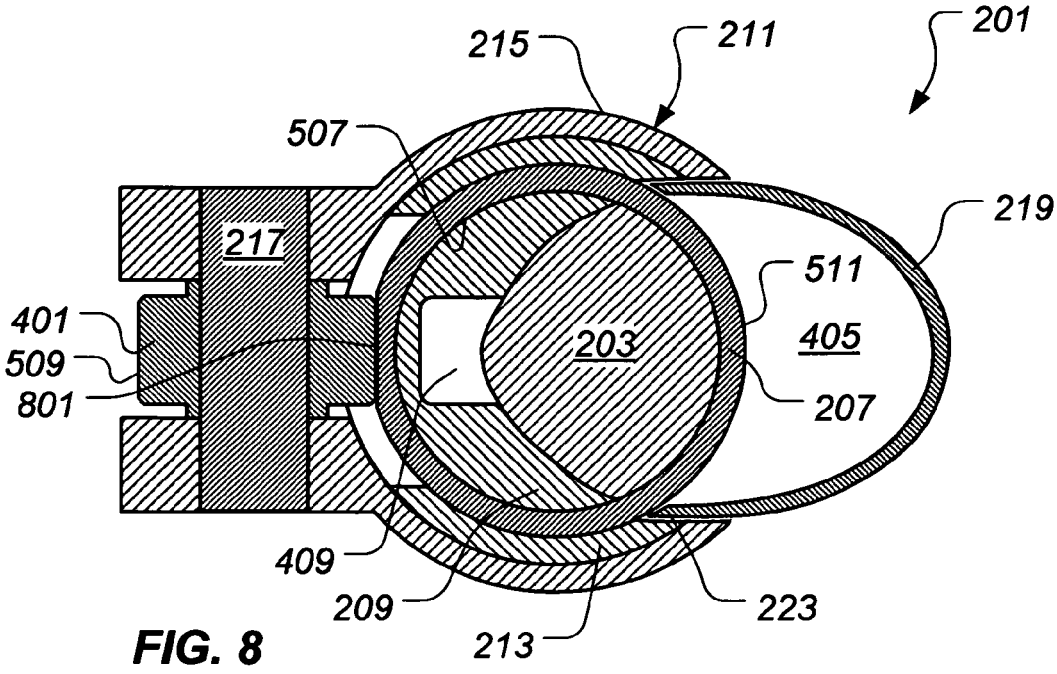
FIG. 8 is an enlarged, cross-sectional view of the kinetic energy penetrator of FIGS. 2 and 3 taken along the line 8-8 of FIG. 2.
Figure 9:
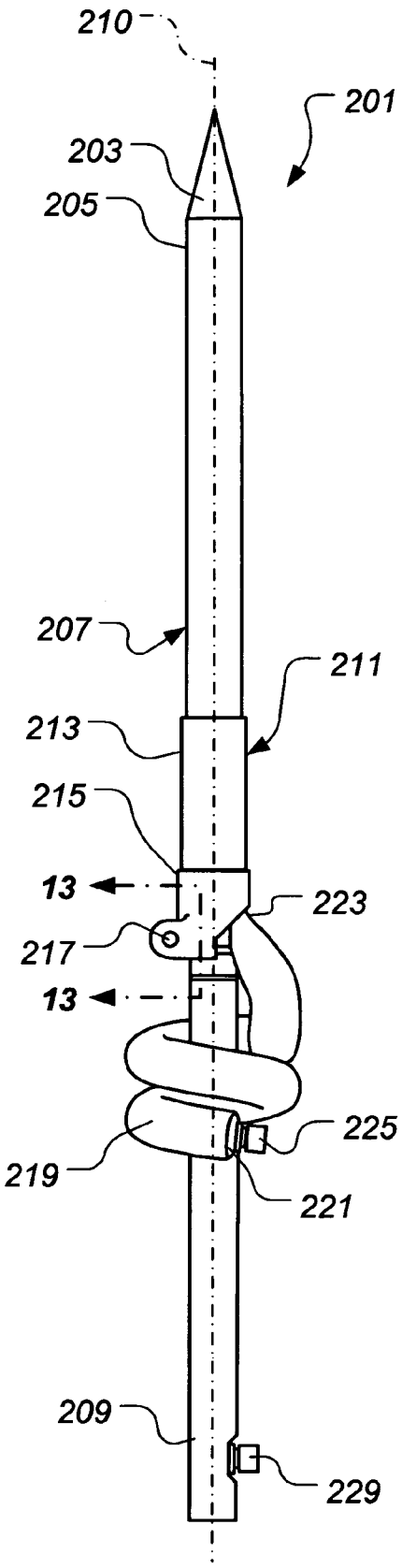
FIG. 9 is a top, plan view of the kinetic energy penetrator of FIGS. 2 and 3 in an extended configuration.
Figure 10:
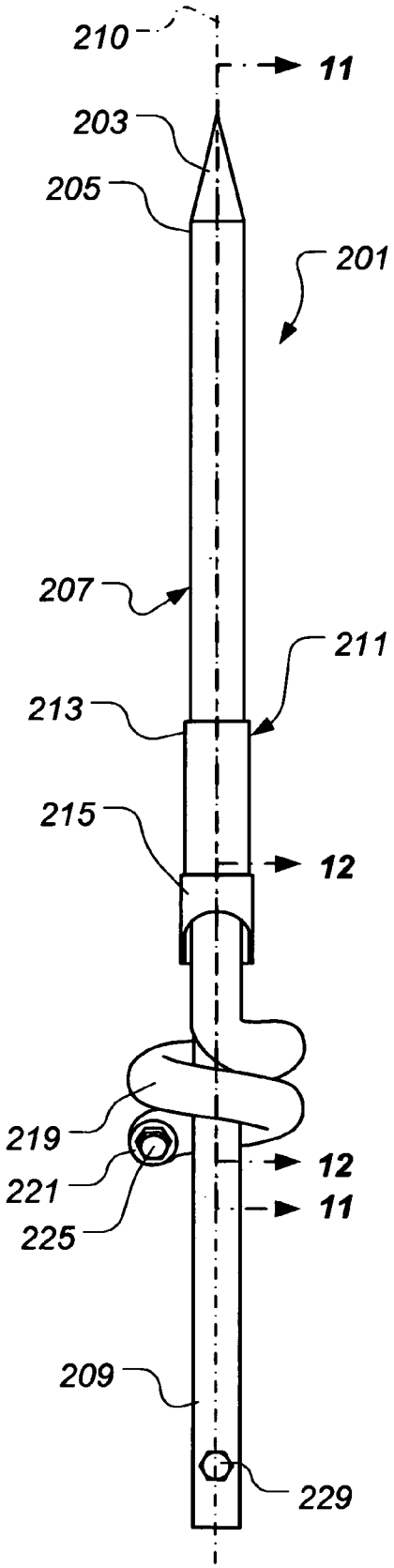
FIG. 10 is a side, elevational view of the kinetic energy penetrator of FIG. 9.
Figure 12:
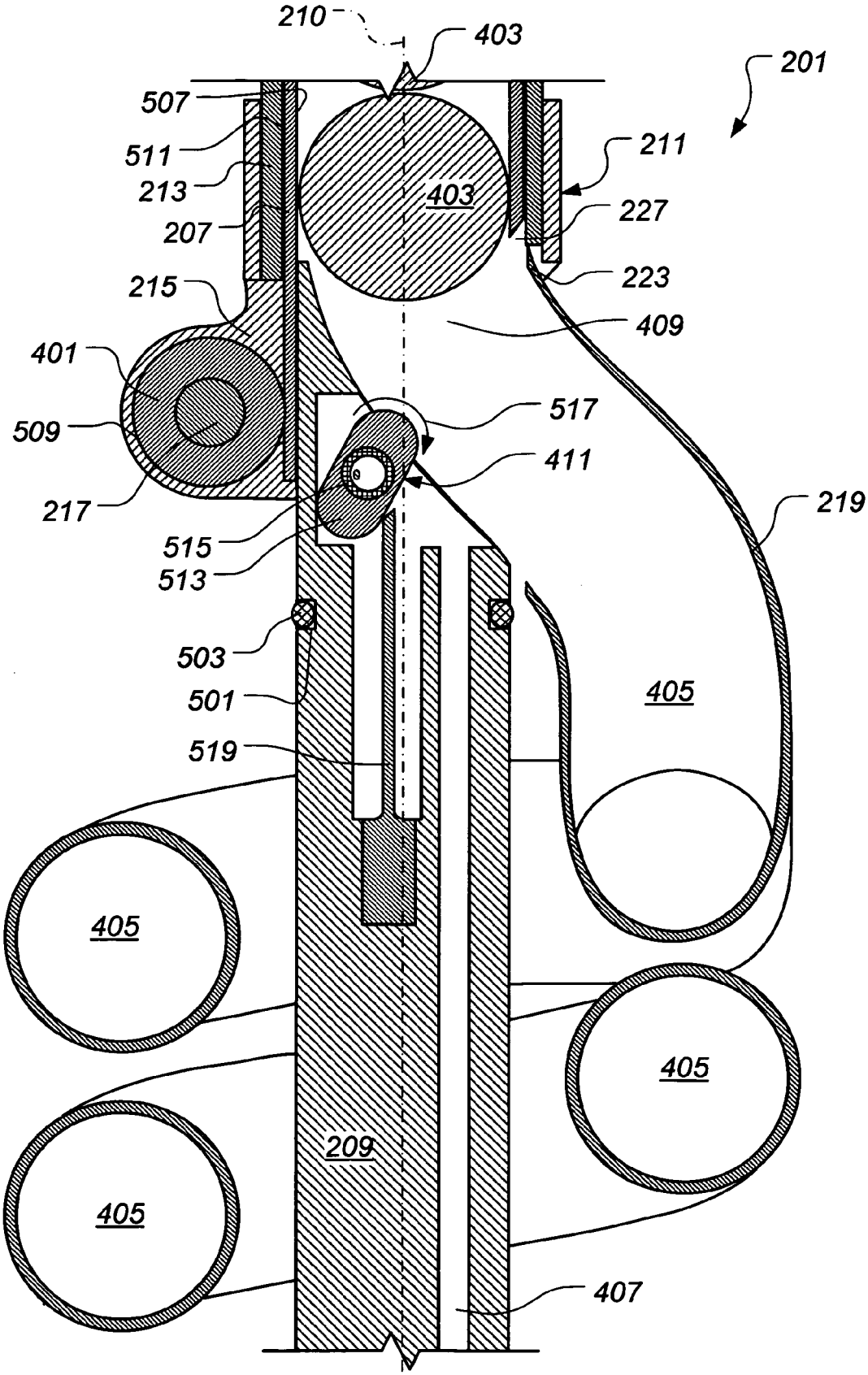
FIG. 12 is an enlarged, cross-sectional view of the kinetic energy penetrator of FIGS. 9 and 10 taken along the line 12-12 in FIG. 10.

Extension tube 207 extends through an extension tube guiding assembly 211. Extension tube guiding assembly 211 comprises a guide bushing 213, through which extension tube 207 is slidingly disposed. Extension tube guiding assembly 211 further includes a roller bracket 215 attached to guide bushing 213 and a roller 401 (best shown in FIG. 5) rotatably mounted to roller bracket 215 via an axle 217. Referring to FIG. 8, a rolling surface 509 of roller 401 contacts and rolls along a flat 801 defined by an outer surface 511 of extension tube 207. Flat 801 extends substantially along a length of extension tube 207. Extension tube guiding assembly 211 guides extension tube 207 as extension tube is moved from the retracted position to the extended position, as will be discussed in greater detail below.

Kinetic energy penetrator 201 further comprises a penetrator segment sleeve 219, which houses a plurality of penetrator segments 403 (shown in FIGS. 4 and 5) prior to penetrator segments 403 being deployed. The deployment of penetrator segments 403 will be discussed in greater detail below. Preferably, penetrator segment sleeve 219 defines a circuitous lumen 405 disposed about extension tube 207, such that penetrator segments 403 are stored in a space-efficient volume, as will be discussed in greater detail below. In the illustrated embodiment, penetrator segment sleeve 219 defines a generally helical lumen 405. Penetrator segment sleeve 219 comprises a closed end 221 and an open end 223. A loading squib 225 extends through closed end 221 into lumen 405. As will be discussed further below, penetrator segments 403 are urged through open end 223 and through an entry opening 227 defined by extension tube 207, into extension tube 207, by gases generated from loading squib 225 after extension tube 207 is moved to the extended position.

In the illustrated embodiment, penetrator segments 403 are generally spherical in shape; however, the present invention is not so limited. Rather, penetrator segments 403 may embody various shapes depending upon their implementation. While penetrator segments 403 may comprise many different materials and combinations of materials, penetrator segments 403 preferably comprise a dense, hard material, such as the material embodiments discussed above concerning kinetic energy precursor 203.

Figure 4:
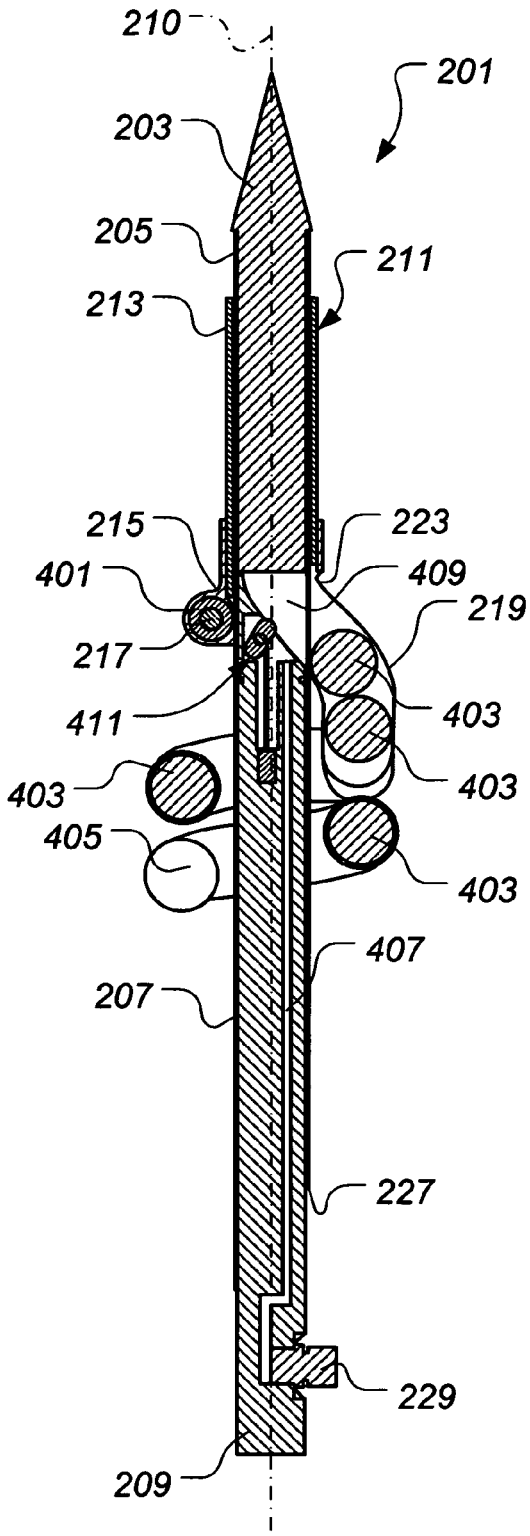
FIG. 4 is a cross-sectional view of the kinetic energy penetrator of FIGS. 2 and 3 taken along the line 4-4 of FIG. 3.
Figure 11:
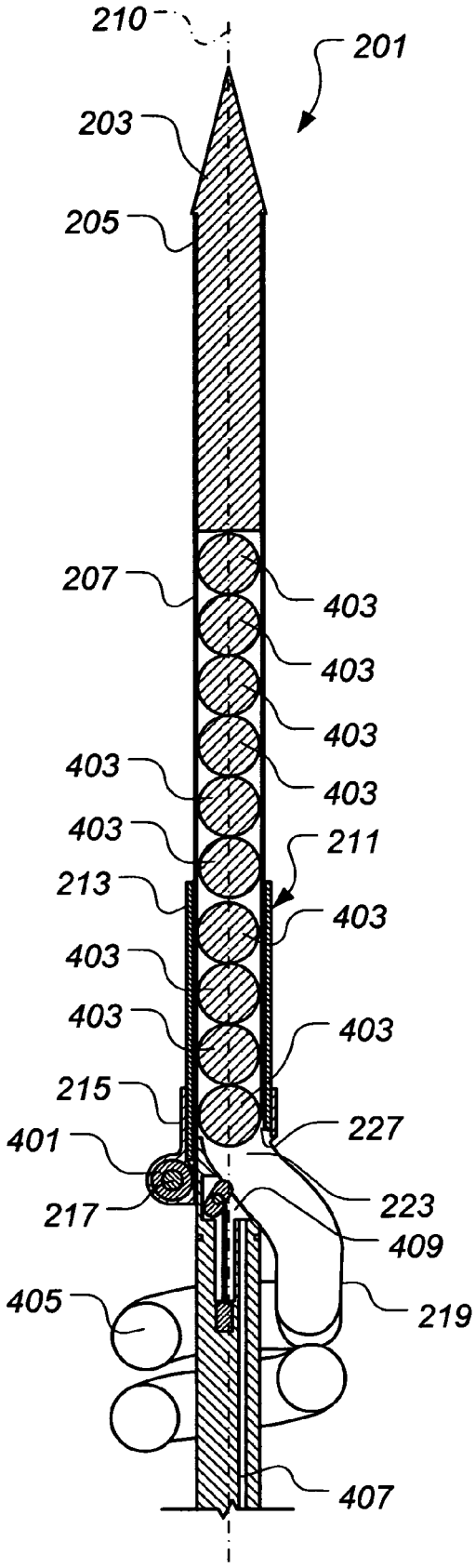
FIG. 11 is cross-sectional view of the kinetic energy penetrator of FIGS. 9 and 10 taken along the line 11-11 in FIG. 10.

Referring in particular to FIG. 4, penetrator rod 209 defines a passageway 407 leading from an extension squib 229 to a cavity 409. In the illustrated embodiment, cavity 409 is defined by penetrator rod 209, extension tube 207, and precursor 203. Extension squib 229, when activated, produces gases that pressurize passageway 407 and cavity 409. As will be discussed in greater detail below, extension tube 207 is extended in response to pressurization of cavity 409.

Figure 5:
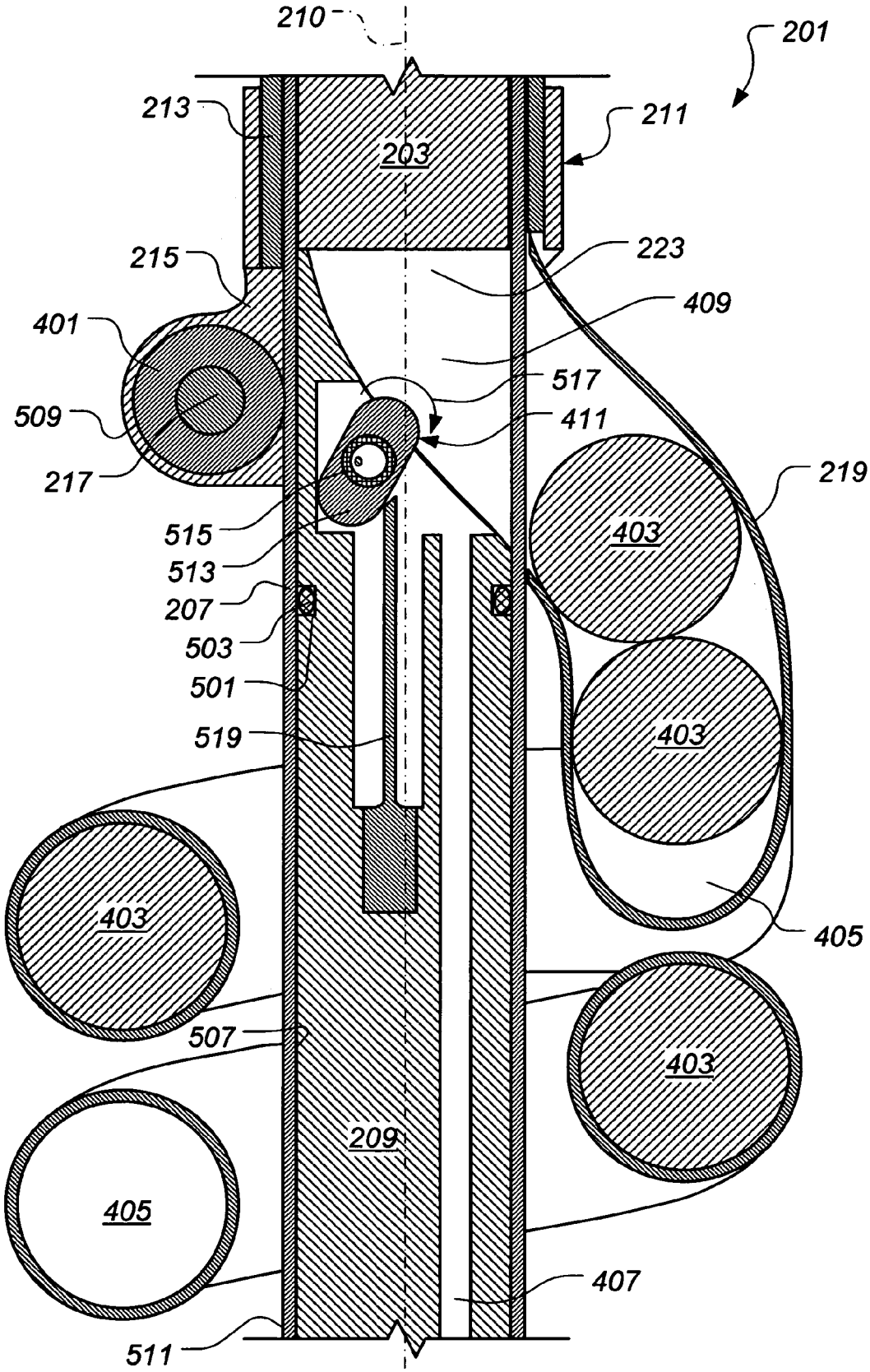
FIG. 5 is an enlarged, cross-sectional view of the kinetic energy penetrator of FIGS. 2 and 3 taken along the line 5-5 of FIG. 3.

As best shown in FIG. 5, kinetic energy penetrator 201 further comprises a locking mechanism 411. In the illustrated embodiment, locking mechanism 411 comprises a penetrator segment stop 513 rotatably mounted to penetrator rod 209 by hollow bushing 515 within cavity 409. Note that penetrator rod 209 limits a rotation of stop 513 in the direction indicated by an arrow 517. Locking mechanism 411 further includes a biasing element 519 extending from penetrator rod 209 to stop 513, biasing stop 513 in the direction of arrow 517. Stop 513 allows ingress of penetrator segments 403 into extension tube 207 and inhibits egress of penetrator segments from extension tube 207, as will be discussed in greater detail below.

Figure 13:
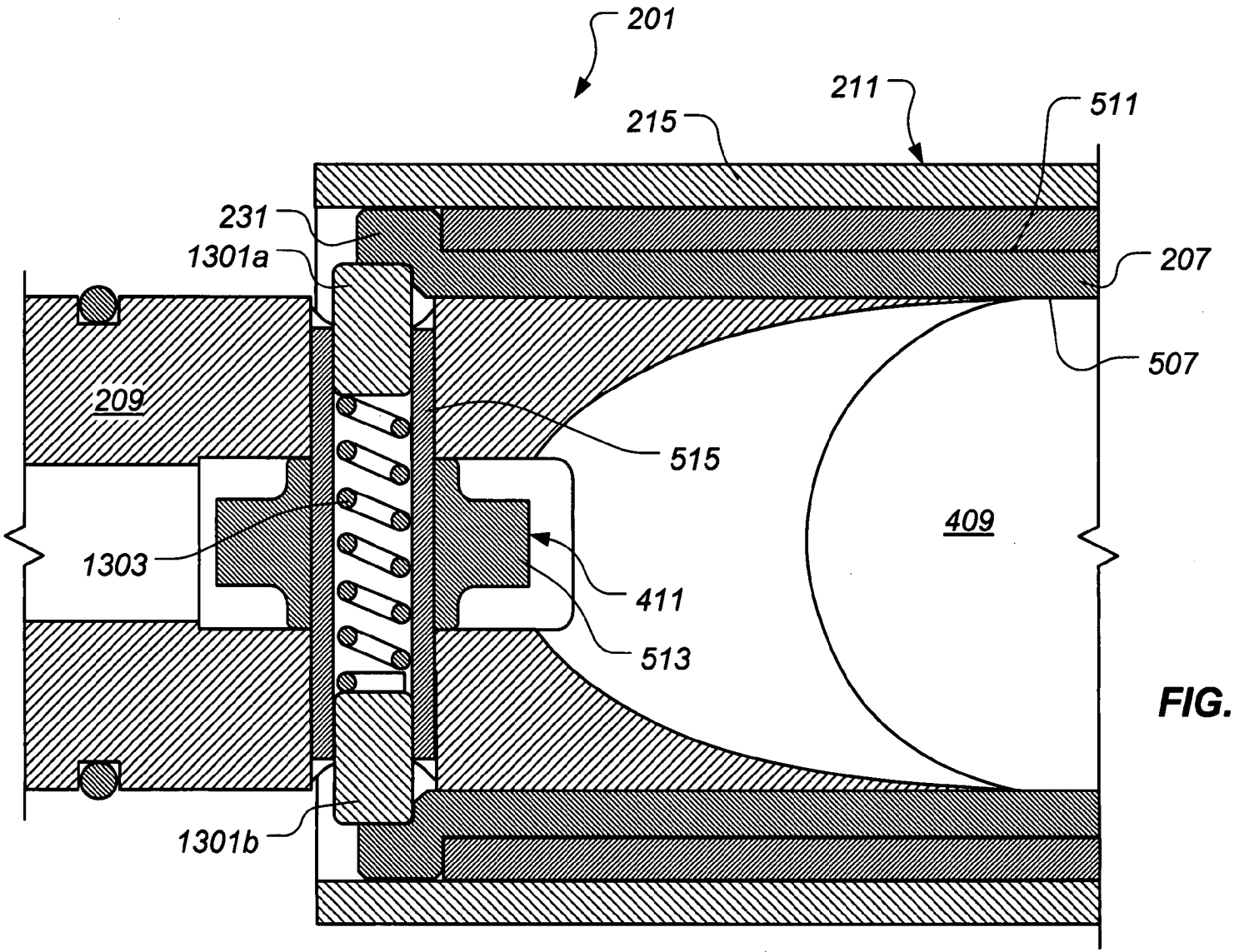
FIG. 13 is an enlarged, cross-sectional view of the kinetic energy penetrator of FIGS. 9 and 10 taken along the line 13-13 of FIG. 9.

As best shown in FIG. 13, locking mechanism 411 further comprises locking pins 1301*a*, 1301*b* and a biasing member 1303 disposed therebetween. Biasing member 1303 urges locking pins 1301*a*, 1301*b* outwardly from hollow bushing 515. Locking pins 1301*a*, 1301*b* engage a flange 231 of extension tube 207 to lock extension tube 207 in the extended position, as will be discussed in greater detail below.

Figure 14:
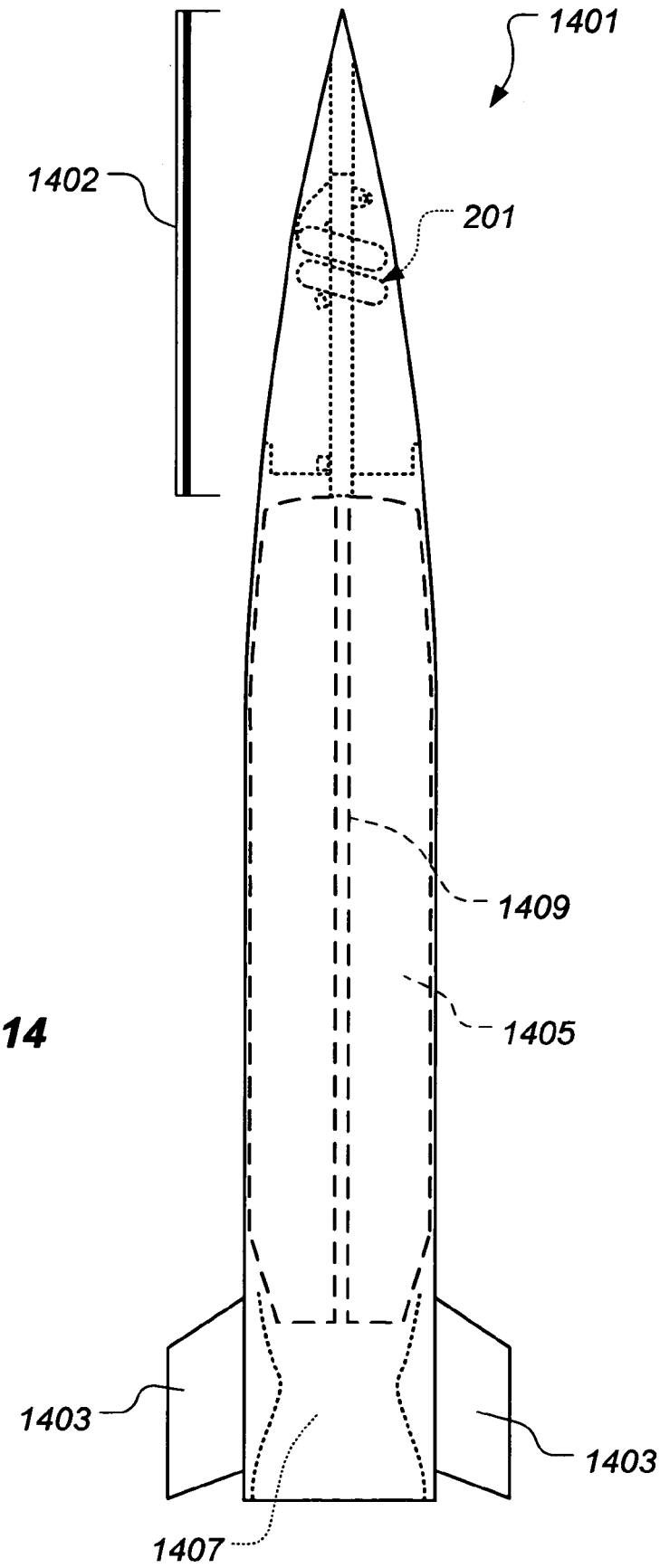
FIG. 14 is a stylized, side, elevational view of an illustrative embodiment of a vehicle according to the present invention incorporating the kinetic energy penetrator of FIGS. 2-13.

FIG. 14 illustrates one particular embodiment of a vehicle 1401 according to the present invention that incorporates kinetic energy penetrator 201. Kinetic energy penetrator 201 is shown in the retracted configuration in FIG. 14. In the illustrated embodiment, kinetic energy penetrator 201 is disposed in a forward portion 1402 of vehicle 1401, along with elements (not shown) that locate targets and/or adjust control surfaces 1403 of vehicle 1401 to deliver vehicle 1401 to a target. Vehicle 1401 further comprises propellant 1405 and a motor 1407 for propelling vehicle 1401. Preferably, kinetic energy penetrator 201 is placed in the extended configuration (shown in FIGS. 9-13) just prior to vehicle 1401 encountering a target or prior to launch of vehicle 1401. In some applications, a very short amount of time is required for vehicle 1401 to reach the target. Accordingly, it may be desirable to place kinetic energy penetrator 201 in the extended configuration prior to launching vehicle 1401.

The ability to reconfigure kinetic energy penetrator 201 allows vehicle 1401 to be stored and transported in a smaller volume than conventional kinetic energy projectiles. Moreover, vehicle 1401 with kinetic energy penetrator 201 in the extended configuration acts as an "aerospike" and encounters less aerodynamic drag than conventional kinetic energy projectiles. Alternatively, forward portion 1402 of vehicle 1401 may have a more blunt configuration with a similar aerodynamic drag as a conventional kinetic energy projectile.

When kinetic energy penetrator 201 is in the retracted configuration, as shown in FIG. 14, a mass associated with the kinetic energy penetrators (e.g., precursor 203, penetrator segments 403, and penetrator rod 209) of kinetic energy penetrator 201 is located more forward in vehicle 1401 than the mass of kinetic energy penetrators of conventional kinetic energy projectiles. Accordingly, when comparing vehicle 1401 to a conventional kinetic energy projectile, such as conventional kinetic energy projectile 101 of FIG. 1, a center of mass of vehicle 1401 is more forward of a center of mass of a conventional kinetic energy projectile. Thus, for similar centers of aerodynamic pressure, vehicle 1401 is more aerodynamically and/or hydrodynamically stable than a conventional kinetic energy projectile. Moreover, smaller control surfaces 1403 may be required, due to a more favorable relationship between the center of gravity and the center of aerodynamic pressure of vehicle 1401 when in high speed flight.

Moreover, penetrator rod 209 does not extend into propellant 1405, as do conventional kinetic energy penetrator rods, such as penetrator rod 105 of FIG. 1. Accordingly, a passageway 1409 defined by propellant 1405, provided for control lines and the like, can be smaller in diameter, yielding a greater volume of propellant 1405. As compared to conventional kinetic energy projectiles, vehicle 1401 can, therefore, travel over greater distances.

One particular operation of kinetic energy penetrator 201 will now be described. When a vehicle, such as vehicle 1401 of FIG. 14 incorporating kinetic energy penetrator 201 is deployed toward a target, kinetic energy penetrator 201 is in the retracted configuration, as shown in FIGS. 2-5 and 8. Penetrator segments 403 are housed in penetrator segment sleeve 219. As vehicle 1401 closely approaches the target, extension squib 229 is activated, thus generating gases to pressurize passageway 407 and cavity 409. Because cavity 409 is substantially fluidly sealed (except for passageway 407 extending to extension squib 229) and the annulus between extension tube 207 and penetrator rod 209 is substantially fluidly sealed by sealing element 503, extension tube 207 is extended with respect to penetrator rod 209, as shown in FIGS. 9-13.

Extension tube 207 is guided by extension tube guiding assembly 211 as extension tube 207 is moved to the extended position. In particular, extension tube 207 moves within guide bushing 213 and roller 401 rolls along flat 801 (shown in FIG. 8) during extension to properly position and orient extension tube 207. Once in the extended position, locking pins 1301*a*, 1301*b* (shown in FIG. 13) engage extension tube 207 to capture flange 231 of extension tube 207 between locking pins 1301*a*, 1301*b* and guide bushing 213. When extension tube 207 is extended, entry opening 227 of extension tube 207 is sufficiently aligned with open end 223 of penetrator segment sleeve 219 to allow passage of penetrator segments 403 from penetrator segment sleeve 219 into extension tube 207.

Note that, at this stage of reconfiguration, penetrator segments 403 are still housed in penetrator segment sleeve 219, as illustrated in FIGS. 4 and 5. Loading squib 225 is activated to load penetrator segments 403 into extension tube 207, as shown in FIGS. 9-12. Specifically, gases generated by loading squib 225 urge penetrator segments 403 through open end 223 of penetrator segment sleeve 219 and entry opening 227 of extension tube 207 into extension tube 207. In this configuration, penetrator segments 403, as well as precursor 203 and penetrator rod 209, are substantially aligned along axis of attack 210. Because the rotational movement of stop 513 is limited in the direction of arrow 517, stop 513 allows penetrator segments 403 to move into extension tube 207 but prevents penetrator segments 403 from moving back into penetrator segment sleeve 219. Kinetic energy penetrator 201 is now in the extended configuration and ready for impact with the target.

When constrained and aligned penetrator segments 403 impact the target, they act in some respects as a solid, one-piece kinetic energy penetrator rod. However, forces imparted to one of penetrator segments 403 that are off-axis of axis of attack 210 are not substantially transmitted to adjacent penetrator segments 403. Thus, while the action of one or more penetrator segments 403 may be disrupted by such a force, other penetrator segments 403 are still effective against the target.

It should be noted that the scope of the present invention includes embodiments wherein precursor 203 is omitted. Moreover, the scope of the present invention includes embodiments wherein penetrator rod 209 is replaced with an element that serves the same purposes for kinetic energy penetrator 201 as penetrator rod 209 except that the element does not act as a kinetic energy penetrator. For example, a lightweight member defining passageway 407 and supporting extension squib 229, biasing element 519, sealing element 503, and locking mechanism 411 may replace penetrator rod 209.

Moreover, it should be noted that loading squib 225 and/or extension squib 229 are merely examples of a means for loading penetrator segments 403 and a means for extending extension tube 207, respectively. One or both of squibs 225, 229 may, in various embodiments, be replaced by, for example, a gas canister, an exhaust gas feed from motor 1407, or another such device that produces a fluid motive force.

It should also be noted that the scope of the present invention encompasses embodiments wherein extension tube 207 is replaced with a non-extending tube for holding penetrator segments 403 substantially along axis of attack 210. In such embodiments, extension squib 229 and passageway 407 of penetrator rod 209 are omitted.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A kinetic energy penetrator, comprising:

a precursor;

a plurality of penetrator segments;

a penetrator segment sleeve for storing the plurality of penetrator segments, the penetrator segment sleeve defining a circuitous lumen for storing the plurality of penetrator segments; and means for moving the plurality of penetrator segments from the penetrator segment sleeve to locations substantially aligned along an axis of attack behind the precursor.

2. The kinetic energy penetrator, according to claim 1, wherein the means for moving the plurality of penetrator segments comprises one of:

a squib, a gas canister, and an exhaust gas feed.

3. A kinetic energy penetrator, comprising:

a precursor;

a plurality of generally spherical penetrator segments;

a penetrator segment sleeve for storing the plurality of penetrator segments; and means for moving the plurality of penetrator segments from the penetrator segment sleeve to locations substantially aligned along an axis of attack behind the precursor.

4. A kinetic energy penetrator, comprising:

a precursor;

a plurality of penetrator segments;

a penetrator segment sleeve for storing the plurality of penetrator segments;

means for moving the plurality of penetrator segments from the penetrator segment sleeve to locations substantially aligned along an axis of attack behind the precursor; and a tube for substantially aligning the plurality of penetrator segments along the axis of attack, wherein the means for moving the plurality of penetrator segments moves the plurality of penetrator segments from the penetrator segment sleeve into the tube.

5. The kinetic energy penetrator, according to claim 4, further comprising:

a locking mechanism for preventing the movement of the plurality of penetrator segments from the tube into the penetrator segment sleeve.

6. A kinetic energy penetrator, comprising:

a tube;

a precursor disposed in the tube;

means for moving the tube from a retracted position to an extended position;

a plurality of penetrator segments;

a penetrator segment sleeve for storing the plurality of penetrator segments; and means for moving the plurality of penetrator segments from the penetrator segment sleeve into the tube behind the precursor when the tube is in the extended position.

7. The kinetic energy penetrator, according to claim 6, further comprising:

a tube guiding assembly for guiding the tube in a proper orientation from the retracted position to the extended position.

8. The kinetic energy penetrator, according to claim 7, wherein the tube guiding assembly comprises:

a bushing for guiding the tube from the retracted position to the extended position.

9. The kinetic energy penetrator, according to claim 6, wherein each of the plurality of penetrator segments is generally spherical.

10. The kinetic energy penetrator, according to claim 6, wherein the penetrator segment sleeve defines a circuitous lumen for storing the plurality of penetrator segments.

11. The kinetic energy penetrator, according to claim 6, wherein the means for moving the plurality of penetrator segments comprises:

one of a squib, a gas canister, and an exhaust gas feed.

12. The kinetic energy penetrator, according to claim 6, further comprising:

a locking mechanism for locking the tube in the extended position.

13. The kinetic energy penetrator, according to claim 6, further comprising:

a locking mechanism for preventing the movement of the plurality of penetrator segments from the tube into the penetrator segment sleeve.

14. A kinetic energy penetrator, comprising:

a tube;

means for moving the tube from a retracted position to an extended position;

a plurality of penetrator segments;

a penetrator segment sleeve for storing the plurality of penetrator segments;

means for moving the plurality of penetrator segments from the penetrator segment sleeve into the tube when the tube is in the extended position; and a tube guiding assembly for guiding the tube in a proper orientation from the retracted position to the extended position;

wherein the tube defines a flat on an outer surface thereof; and wherein the tube guiding assembly comprises:

a roller adapted to roll along the flat as the tube is moved from the retracted position to the extended position.

15. A method, comprising:

providing a precursor attached to a tube for substantially aligning the plurality of penetrator segments along an axis of attack;

storing a plurality of penetrator segments away from the axis of attack;

moving the tube from a retracted position to an extended position; and moving the plurality of penetrator segments to locations substantially aligned along the axis of attack behind the precursor.

16. The method, according to claim 15, wherein storing the plurality of penetrator segments is accomplished by storing the plurality of penetrator segments in a penetrator segment sleeve.

17. The method, according to claim 15, wherein moving the plurality of penetrator segments is accomplished by moving the plurality of penetrator segments via a fluid motive force.

18. The method, according to claim 15, wherein moving the plurality of penetrator segments is accomplished by moving the plurality of penetrator segments into a tube.

19. The method, according to claim 15, wherein moving the tube is accomplished by moving the tube via a fluid motive force.

20. A vehicle, comprising:

a motor for propelling the vehicle into a target;

a body, a rear portion of the body housing the motor; and a kinetic energy penetrator disposed in a forward portion of the body, the kinetic energy penetrator comprising:

a precursor;

a plurality of penetrator segments;

a penetrator segment sleeve for storing the plurality of penetrator segments; and means for moving the plurality of penetrator segments from the penetrator segment sleeve to locations substantially aligned along an axis of attack behind the precursor.

* * * * *